252-151 AU 156 EX
12/20/83 XR 4,421,667

United States Patent [19]
Louthan et al.

[11] 4,421,667
[45] Dec. 20, 1983

[54] SULFUR BASED METAL CLEANERS

[75] Inventors: Merlin R. Lindstrom, Gary D. Macdonell, Rector P. Louthan; all of Bartlesville, Okla.

[73] Assignee: Phillips Petroleum Company, Bartlesville, Okla.

[21] Appl. No.: 427,222

[22] Filed: Sep. 29, 1982

[51] Int. Cl.[3] ..... C11D 7/06; C11D 7/32; C11D 7/34

[52] U.S. Cl. ..... 252/156; 252/542; 252/545; 252/526; 252/523; 252/541; 252/151

[58] Field of Search ..... 544/59; 252/542, 545, 252/526, 523, 541, 151, 156, 391, 395, 390, 394; 148/6.17

[56] References Cited

U.S. PATENT DOCUMENTS

| | | | |
|---|---|---|---|
| 2,375,628 | 5/1945 | D'Alelio et al. | 544/59 |
| 2,439,749 | 4/1948 | Niederl | 544/59 |
| 2,562,145 | 6/1951 | Harman et al. | 260/243 |
| 2,706,194 | 4/1955 | Morris et al. | 522/390 |
| 2,729,636 | 1/1956 | Erickson | 544/59 |
| 3,741,834 | 6/1973 | William et al. | 252/542 |

FOREIGN PATENT DOCUMENTS 521354 9/1976 U.S.S.R. .

*Primary Examiner*—John E. Kittle
*Assistant Examiner*—Hoa Van Le

[57] ABSTRACT

A novel composition and process are provided for cleaning metallic surfaces. The aqueous cleaning composition comprises an effective amount of at least one thiomorpholine compound represented by the formula:

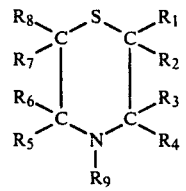

where $R_1$, $R_2$, $R_3$, $R_4$, $R_5$, $R_6$, $R_7$, and $R_8$ can be hydrogen or any hydrocarbyl radical having from 1 to 3 carbon atoms and where the total number of carbon atoms in $R_1$, $R_2$, $R_3$, $R_4$, $R_5$, $R_6$, $R_7$, and $R_8$ not to exceed about 10 carbon atoms; and where $R_9$ is hydrogen or any hydrocarbyl radical having from 1 to 8 carbon atoms, metal hydroxide, and water soluble surfactant.

8 Claims, No Drawings

SULFUR BASED METAL CLEANERS

This invention relates to the cleaning of metal surfaces.

The surface cleanliness of metal surfaces is known to influence the physical and chemical properties of that surface. The surfaces of most metallic materials are covered either by a metal oxide due to oxidation, organic residues from the annealing process, or protective oils applied during a fabrication process. It is known to those skilled in the art that it is advantageous to remove these materials from the metal surface prior to subsequent handling such as, for example, a coating processes in order to obtain the maximum benefit from the coating.

Cleaning of metal surfaces is a laborious task at best. Cleaning agents for metallic surfaces of various types have been suggested, such as grinding compounds containing abrasives, corrosive and toxic materials like acid, and sometimes a chemical additive which has not necessarily assisted the cleaning process. For example, high molecular weight long chain alkyl mercaptans have been used in such formulations. Unfortunately, as chemical additives, these mercaptans leave an objectionable greasy film on the surface of the metal. In addition, many of these compounds are malodorous.

Of course, the use of abrasives, generally is undesirable. The metal surface, must, perforce, be worn away to at least a slight extent, at each and every abrading. In time this depreciates the value of the article involved, particularly plated ones. The abrading itself, even with finely divided abrasives, tends to increase the total surface area of the metal exposed to the corrosion causing environment. The same is true when corrosive and toxic materials are used.

An effective class of cleaning agents is certainly to be desired to remove contamination from common metal surfaces such as brass, copper, and steel.

It is an object of this invention to provide novel compositions suitable for cleaning brass, copper, and steel surfaces. It is a further object of this invention to provide a process for the cleaning of brass, copper, and steel surfaces.

Other aspects, objects, and the several advantages of this invention will be obvious to one skilled in the art to which our invention most nearly pertains from the following description and from the appended claims.

In accordance with the present invention it has been discovered that certain sulfur containing compounds are unusually effective agents for the removal of contaminants from brass, copper, and steel surfaces. More particularly, thiomorpholine compounds have been found to be effective cleaning agents for brass, copper and steel surfaces.

The thiomorpholine compounds useful within the context of this invention can be represented by the generalized formula

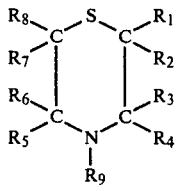

where $R_1$, $R_2$, $R_3$, $R_4$, $R_5$, $R_6$, $R_7$, and $R_8$ can be hydrogen or any hydrocarbyl radical having from 1 to 3 carbon atoms and where the total number of carbon atoms in $R_1$, $R_2$, $R_3$, $R_4$, $R_5$, $R_6$, $R_7$, and $R_8$ does not exceed about 10 carbon atoms; and where $R_9$ is hydrogen or any hydrocarbyl radical having from 1 to 8 carbon atoms. In addition, the aforementioned thiomorpholines must have a water solubility of at least 1.0 weight percent.

Examples of these thiomorpholine compounds include 2,6-dimethylthiomorpholine, 2,3,4,5,6-hexamethylthiomorpholine, 2,2,6,6-tetramethylthiomorpholine, 2,6-n-propyl-4-octyl-thiomorpholine and mixtures thereof.

In the case of the compound indicated above a general maximum total number of carbon atoms per individual compound upper limit is dictated primarily by upper feasible solubility limits of the individual compounds in the applications and processes according to the present invention.

The compound of the present invention can be prepared by heating a dialkyl amine or alkyl substituted diallyl amine with hydrogen sulfide in a manner described in U.S. Pat. No. 2,562,145.

The aqueous cleaning composition of the present invention will comprise effective amounts of at least one thiomorpholine compound as described above, at least one Group IA or IIA metal hydroxide, and at least one water soluble surfactant. Any water soluble surfactant can be used in the present invention. However, an anionic surfactant such as an alkyl aryl sulfonate are typically used.

An effective amount of each of the above ingredients is defined, for the purposes of this invention, to be that amount of the ingredient necessary to effectuate proper cleaning of the metal surface involved. It is contemplated in the present invention that the effective amount of each ingredient needed will vary from composition to composition depending upon the particular steel surface to be cleaned.

Generally, the aqueous cleaning composition will comprise from about 80.0 to 99.55 weight percent water, from about 0.1 to 5.0 weight percent of at least one water soluble surfactant, from about 0.1 to about 5.0 weight percent of at least one Group IA or IIA metal hydroxide, and from about 0.25 to about 10.0 weight percent of at least one thiomorpholine compound as described above.

In the process of the present invention the contaminated metal surface is cleaned by contacting the surface with the cleaning composition described earlier.

Samples of metal, such as coupons, brass, copper and steel can be immersed in any type of agitated bath, such as an ultrasonic bath, consisting of the ingredients described above, i.e., water and at least one sulfur containing compound, a Group IA or IIA metal hydroxide, and a water soluble surfactant. This combination of metal coupons and cleaning solution can then be stirred and heated at any temperature and for any time suitable to effectuate proper cleaning. Typically the metals are heated in a cleansing solution at a temperature between about 70° to 200° F. for no longer than about 15 minutes. By the process of the present invention, the resulting metal surfaces should be substantially free of contaminants.

The following Examples further illustrate the present invention.

EXAMPLE

This example serves to illustrate the operability of this invention when using thiomorpholines as active ingredients in aqueous metal surface cleaning solutions. The test consists of immersing 1 inch×5 inches×0.400 inch steel, 1 inch×5 inch×0.035 inch brass, and 1 inch×5 inch×0.025 inch copper coupons into an aqueous cleaning solution containing 1 weight percent sodium hydroxide, or 1 weight percent surfactant (Triton X-202, sodium alkylaryl polyether sulfonate), or 2 weight percent of the active sulfur-base ingredient such as 2,6-dimethylthiomorpholine or combinations of all three. The solutions were heated to 90° F., 140° F., or 190° F. and stirred in an ultrasonic bath. The uncleaned metal coupons were periodically removed from the bath, rinsed in running tap water, visually rated for appearance, and evaluated for cleanliness by the water break-free test. This test is discussed in Metal Finishing, 45 (12), pg. 77, 78, 88 (1947), "Testing of Alkaline Metal Cleaners" by A. Mankowich and Organic Finishing, "Method of Evaluating Alkali Cleaners", 1946, pg. 9 by C. Nielson. Water break-free test means the surface remains water-wetted without breaking away. At this point the surface is considered clean. The surfaces were also examined for general cleaning in addition to water break-free. Using the procedure described, the compound 2,6-dimethylthiomorpholine was evaluated as an active ingredient in a cleaning solution. The data listed in Table I indicates the thiomorpholine is not active in cleaning metal unless an alkali metal hydroxide and a surfactant are both present. The data also shows the thiomorpholine most active at elevated temperatures, particularly at 190° F. and most active on steel surfaces, followed by copper surfaces and less active on brass.

TABLE I

Effect of 2,6-Dimethylthiomorpholine as a Cleaning Solution Ingredient

| Cleaning Solution | Minutes Till Cleaning and/or Break-Free[a] | | | | | | | | |
|---|---|---|---|---|---|---|---|---|---|
| | Brass | | | Copper | | | Steel | | |
| | 90° F. | 140° F. | 190° F. | 90° F. | 140° F. | 190° F. | 90° F. | 140° F. | 190° F. |
| Controls | | | | | | | | | |
| 1. 1% Aq. NaOH | ←——→ | | | NSC[b], Discolors | | | ←——→ | | |
| 2. 1%, Aq. Triton X-202[c] | ←——→ | | | NSC, Discolors | | | ←——→ | | |
| 3. 1% Aq. NaOH, 1% Ag. Triton X-202 | ←——→ | | | NSC, Discolors | | | ←——→ | | |
| 4. 2% Aq. DTM[d] | ←——→ | | | NSC | | | ←——→ | | |
| 5. 2% Aq. DTM, 1% Aq. Triton X-202 | ←——→ | | | NSC | | | ←——→ | | |
| Invention | | | | | | | | | |
| 6. 2% Aq. DTM, 1% Aq. Triton X-202, 1% Aq. NaOH | >15 | >15 | 3-5 | 10 | 3 | 3 | 10 | 5 | 0.5 |

[a]Break-free means the surface remains water-wetted without breaking away.
[b]No significant change.
[c]An anionic surfactant identified as an alkyl aryl polyether sulfonate from Rohm and Haas.
[d]2,6-Dimethylthiomorpholine also referred to as 2,6-dimethyl-1,4-thiazone.

Certainly reasonable variations and modifications are possible within the scope of this disclosure, yet without departing from the reasonable scope and certainly not from the intended spirit thereof, as shown by the specification itself, including the claims here appended.

We claim:

1. An aqueous composition suitable as a metallic cleaning agent comprising a metal cleaning effective amount of at least one (a) thiomorpholine compound represented by the formula:

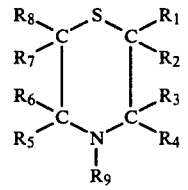

where $R_1$, $R_2$, $R_3$, $R_4$, $R_5$, $R_6$, $R_7$, and $R_8$ can be hydrogen or any hydrocarbyl radical having from 1 to 3 carbon atoms ans where the total number of carbon atoms in $R_1$, $R_2$, $R_3$, $R_4$, $R_5$, $R_6$, $R_7$, and $R_8$ not to exceed about 10 carbon atoms; and where $R_9$ is hydrogen or any hydrocarbyl radical having from 1 to 8 carbon atoms;

(b) Group IA or IIA metal hydroxide; and (c) water soluble surfactant.

2. A composition according to claim 1 wherein said thiomorpholine compound is 2,6-dimethylthiomorpholine.

3. An aqueous composition suitable as a metallic cleaning agent comprising:

(a) from about 80.0 to 99.55 weight percent water;

(b) from about 0.1 to 5.0 weight percent of at least one water soluble surfactant;

(c) from about 0.1 to 5.0 weight percent of at least one Group IA or IIA metal hydroxide; and (d) from about 0.25 to 10.0 weight percent of at least one thiomorpholine compound represented by the formula

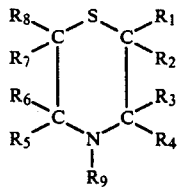

where $R_1$, $R_2$, $R_3$, $R_4$, $R_5$, $R_6$, $R_7$, and $R_8$ can be hydrogen or any hydrocarbyl radical having from 1 to 3 carbon atoms ans where the total number of carbon atoms in $R_1$, $R_2$, $R_3$, $R_4$, $R_5$, $R_6$, $R_7$, and $R_8$ not to exceed about 10 carbon atoms; and where $R_9$ is hydrogen or any hydrocarbyl radical having from 1 to 8 carbon atoms.

4. A composition according to claim 3 wherein said thiomorpholine compound is 2,6-dimethylthiomorpholine.

5. A process for the cleaning of metallic brass, copper, and steel surfaces which comprises bringing said metallic surfaces into contact with an aqueous composition comprising effective amounts of at least one (a) thiomorpholine compound represented by the formula:

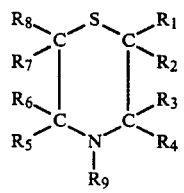

where $R_1$, $R_2$, $R_3$, $R_4$, $R_5$, $R_6$, $R_7$, and $R_8$ can be hydrogen or any hydrocarbyl radical having from 1 to 3 carbon atoms ans where the total number of carbon atoms in $R_1$, $R_2$, $R_3$, $R_4$, $R_5$, $R_6$, $R_7$, and $R_8$ not to exceed about 10 carbon atoms; and where $R_9$ is hydrogen or any hydrocarbyl radical having from 1 to 8 carbon atoms;

(b) Group IA or IIA metal hydroxide; and (c) water soluble surfactant.

6. A composition according to claim 5 wherein said thiomorpholine compound is 2,6-dimethylthiomorpholine.

7. A process for the cleaning of metallic brass, copper and steel surfaces which comprises bringing said metallic surfaces into contact with a composition comprising:

(a) from about 80.0 to 99.55 weight percent water;

(b) from about 0.1 to 5.0 weight percent of at least one water soluble surfactant;

(c) from about 0.1 to 5.0 weight percent of at least one Group IA or IIA metal hydroxide; and (d) from about 0.25 to 10.0 weight percent of at least one thiomorpholine compound represented by the formula:

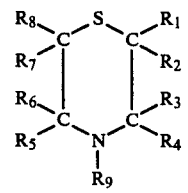

where $R_1$, $R_2$, $R_3$, $R_4$, $R_5$, $R_6$, $R_7$, and $R_8$ can be hydrogen or any hydrocarbyl radical having from 1 to 3 carbon atoms ans where the total number of carbon atoms in $R_1$, $R_2$, $R_3$, $R_4$, $R_5$, $R_6$, $R_7$, and $R_8$ not to exceed about 10 carbon atoms; and where $R_9$ is hydrogen or any hydrocarbyl radical having from 1 to 8 carbon atoms.

8. A composition according to claim 7 wherein said thiomorpholine compound is 2,6-dimethylthiomorpholine.

* * * * *